US007452014B2

(12) United States Patent
Vetter

(10) Patent No.: US 7,452,014 B2
(45) Date of Patent: Nov. 18, 2008

(54) MULTI-POINT SASH LOCK SYSTEM FOR CASEMENT WINDOW

(75) Inventor: Gregory J. Vetter, Owatonna, MN (US)

(73) Assignee: Truth Hardware Corporation, Owatonna, MN (US)

( * ) Notice: Subject to any disclaimer, the term of this patent is extended or adjusted under 35 U.S.C. 154(b) by 109 days.

(21) Appl. No.: 11/381,200

(22) Filed: May 2, 2006

(65) Prior Publication Data

US 2007/0096476 A1 May 3, 2007

Related U.S. Application Data

(60) Provisional application No. 60/677,429, filed on May 2, 2005.

(51) Int. Cl.
*E05C 19/00* (2006.01)

(52) U.S. Cl. ..... 292/302; 49/395; 292/DIG. 20

(58) Field of Classification Search ..... 292/DIG. 20, 292/DIG. 33, 35, 36, 38, 302; 49/394, 395
See application file for complete search history.

(56) References Cited

U.S. PATENT DOCUMENTS

| | | | | |
|---|---|---|---|---|
| 1,385,102 | A | 7/1921 | Winters et al. | |
| 2,548,578 | A * | 4/1951 | Andersson et al. | 292/141 |
| 3,949,525 | A | 4/1976 | Bates et al. | |
| 4,148,106 | A | 4/1979 | Gallien | |
| 4,602,457 | A | 7/1986 | Kreusel | |
| 4,739,583 | A | 4/1988 | Tönsmann et al. | |
| 4,803,808 | A | 2/1989 | Greisner | |
| 4,980,946 | A | 1/1991 | Verasani et al. | |
| 4,991,886 | A | 2/1991 | Nolte et al. | |
| 5,045,265 | A | 9/1991 | Pettit | |
| 5,087,087 | A | 2/1992 | Vetter et al. | |
| 5,118,145 | A | 6/1992 | Tucker | |
| 5,370,428 | A | 12/1994 | Dreifert et al. | |
| 5,603,538 | A | 2/1997 | Evers | |
| 5,642,909 | A * | 7/1997 | Swan et al. | 292/39 |
| 5,741,031 | A | 4/1998 | Bauman et al. | |
| 5,778,602 | A | 7/1998 | Johnson et al. | |
| 5,839,767 | A | 11/1998 | Piltingsrud | |
| 5,927,767 | A | 7/1999 | Smith et al. | |
| 6,135,511 | A | 10/2000 | Smith et al. | |
| 6,161,881 | A | 12/2000 | Babka et al. | |
| 6,367,853 | B1 | 4/2002 | Briggs | |
| 6,477,810 | B2 * | 11/2002 | Van De Keuken | 49/395 |
| 6,651,389 | B2 * | 11/2003 | Minter et al. | 49/394 |

(Continued)

OTHER PUBLICATIONS

Rejuvenation, Large Brass Casement Window Fastener 8289, www.rejuvenation.com, Mar. 3, 2005, pp. 1.

(Continued)

*Primary Examiner*—Gary Estremsky
(74) *Attorney, Agent, or Firm*—Patterson, Thuente, Skaar & Christensen PA

(57) ABSTRACT

A multi-point sash lock assembly being shiftable between a locked and an unlocked disposition includes a tie bar assembly including a tie bar guide, the tie bar guide having at least one guide end, the guide end being integrally, unitarily formed. A multi-point sash lock assembly for securing a rounded side of a window to a rounded window frame and a method of forming a multi-point sash lock assembly are further included.

7 Claims, 12 Drawing Sheets

U.S. PATENT DOCUMENTS 6,837,004 B2 1/2005 Annes
7,004,515 B2 * 2/2006 Timothy ..... 292/137

OTHER PUBLICATIONS

Ferco Corp., Fittings for tilt-turn gears Jet As 130 Aluminium joinery, 1991, pp. 12.

Truth Hardware, Multi-Point Locking System, *Truth Hardware Catalog*, 1993, pp. 2.7-2.7g.

Truth Hardware, Engineering Drawing 31868, Nov. 3, 1996, pp. 1.

Truth Hardware, Mirage™ Concealed Multi-Point Locking System, *Truth Hardware Catalog*, 1996, pp. 2.5-2.5k.

* cited by examiner

MULTI-POINT SASH LOCK SYSTEM FOR CASEMENT WINDOW

RELATED APPLICATION

The present application claims the benefit of U.S. Provisional Application No. 60/677,429 filed May 2, 2005, which is incorporated herein in its entirety by reference.

FIELD OF THE INVENTION

The present invention relates to lock systems and more specifically to sash lock systems for casement windows.

BACKGROUND OF THE INVENTION

Multi-point sash lock systems for casement windows are known. Such known systems are disclosed in U.S. Pat. Nos. 4,803,808; 5,087,087; and 5,118,145, hereby fully incorporated herein by reference. These systems typically have a single operating control, usually a lever. The lever is typically linked to a tie-bar that has multiple engaging structures disposed at intervals along its length. Operation of the lever causes the tie-bar to move longitudinally. Keepers are attached to the window sash proximate the locations of each of the engaging structures so that as the tie-bar moves, the engaging structures are moved in and out of engagement with the keepers. The entire sash lock assembly is usually concealed in the frame construction of the window, with the exception of the lever, which projects from a slot on the interior side of the window.

These known mechanisms, while being generally adequate for locking a window sash have not provided entirely satisfactory performance in some respects. Installation of the lock assembly on the window frame and sash is difficult with some prior systems because it is necessary to carefully measure and accurately position the tie-bar at the correct distance from the locked position of the window sash. If the tie-bar is located too far away from the sash location, the engaging structures will not engage the keepers. If the tie bar is too close, the engaging structures may interfere with the window sash itself. Although some prior art systems have addressed this problem by providing a locating lip on the tie-bar guide that engages in a pre-located groove in the window frame, these systems have not been entirely satisfactory in that the locating lip of the guide must fit snugly into the groove so as to avoid misalignment of the guide when it is secured to the window frame. Such misalignment may cause binding of the tie bar in the guides. Moreover, this operation consumes valuable time and effort in a mass production environment.

Further, it is necessary to locate tie bar guide structures along the length of the tie bar at optimal positions for operation of the mechanism. In some prior systems, this process must be done manually for each individual window, adding time and cost to assembly of the window. Again, although some prior systems have addressed this problem by securing the tie bar guide to the tie bar before installation with a structure that is then destroyed upon first operation of the window in order to release the guide from the tie bar, these systems have not been entirely satisfactory. In some cases, the prior systems are prone to come loose before the tie bar assembly is secured to the window frame. In addition, prior systems generally require an aperture to be formed in the tie bar that engages a structure on the guide. These systems require additional steps in manufacturing in order to form the aperture and engaging structure.

The keeper structure of prior mechanisms has not been entirely satisfactory in prior systems. Many prior systems have a keeper in which the keeper hook extends outwardly at 90 degrees from a flange portion which is secured to the window with fasteners. Such a system, which loads the fasteners axially in part, is prone to the keeper being pulled from the sash in high winds. Other systems, using a flat keeper secured to the sash are also known. These prior systems, however, generally have multiple fastener holes, which must be secured with precisely positioned fasteners, adding time and cost to window fabrication.

Also, the lever handle arrangement of some prior systems has presented particular problems during construction. It is desirable to ship the window to a construction site with the finish hardware not attached so as to prevent scratching or other damage during window shipping and installation. It is also desirable and sometimes essential, however, to operate the window prior to installation being complete. In prior systems, the window lock system cannot be operated without the finish hardware being attached.

Further, round top architectural windows having an operable sash are becoming increasingly popular. Prior art multi-point sash lock systems do not generally provide the capability of locking such a round top window sash with the same system as for the remainder of the window. The locking system should conform to the rounded side of the window and should function in a manner similar to that for a straight side.

What is needed in the industry is a multi-point sash lock system that addresses these needs.

SUMMARY OF THE INVENTION

The present invention is an improved sash lock system for casement windows that addresses the needs of the industry. In an embodiment, the invention includes a tie bar assembly having a tie bar longitudinally slidable with a lock drive operable with a lever. The tie bar has a plurality of rollers for engaging keepers (known as biscuit keepers) spaced apart on the window sash. The tie bar is guided with a plurality of guides secured to the window frame. Each guide has a pair of spaced apart guide portions, each with a separate locating lip for engaging a pre located groove in the window frame. The spaced apart position of the locating lip and overall greater length of the guide enable more accurate alignment of the guide to prevent binding of the tie bar. Further, the guide has a locating tab which may be molded as part of the central structure of the guide connecting the guide portions. The locating tab is riveted directly to the tie bar using the same rivet as is used for the roller. Upon first operation of the mechanism, the locating tab is ripped from the guide and remains attached to the tie bar thereafter. This locating method uses fewer parts and saves time in assembly as compared to the prior systems.

In an embodiment, the lever is equipped with finish hardware, including a detachable finish sleeve and removable escutcheon. The lever itself is of sufficient length so as to project from the slot and be grasped to effect unlocking operation even without the finish sleeve in place. Hence, the sash lock system is operable during construction, while enabling the finish hardware to be installed at the last minute so as to minimize the risk of damage.

In an embodiment, the mechanism has a plurality of flat biscuit keepers. These keepers are installed in the sash in grooves cut with a plunge saw. The portion of the keeper that is inserted in the slot has a single slot that receives multiple fasteners to secure the keeper in place. This keeper saves assembly time as compared to prior art systems due to the slot, which eliminates the need to precisely locate the fasteners in apertures.

In an embodiment the present invention provides the capability of locking a round top window sash with the same system as for the remainder of the window wherein a generally linear configuration is used.

The present invention is a multi-point sash lock assembly being shiftable between a locked and an unlocked disposition, including a tie bar assembly including a tie bar guide, the tie bar guide having at least one guide end, the guide end being integrally, unitarily formed. The present invention is further a multi-point sash lock assembly for securing a rounded side of a window to a rounded window frame and a method of forming a multi-point sash lock assembly.

DETAILED DESCRIPTION OF THE PREFERRED EMBODIMENTS

Figure 1:
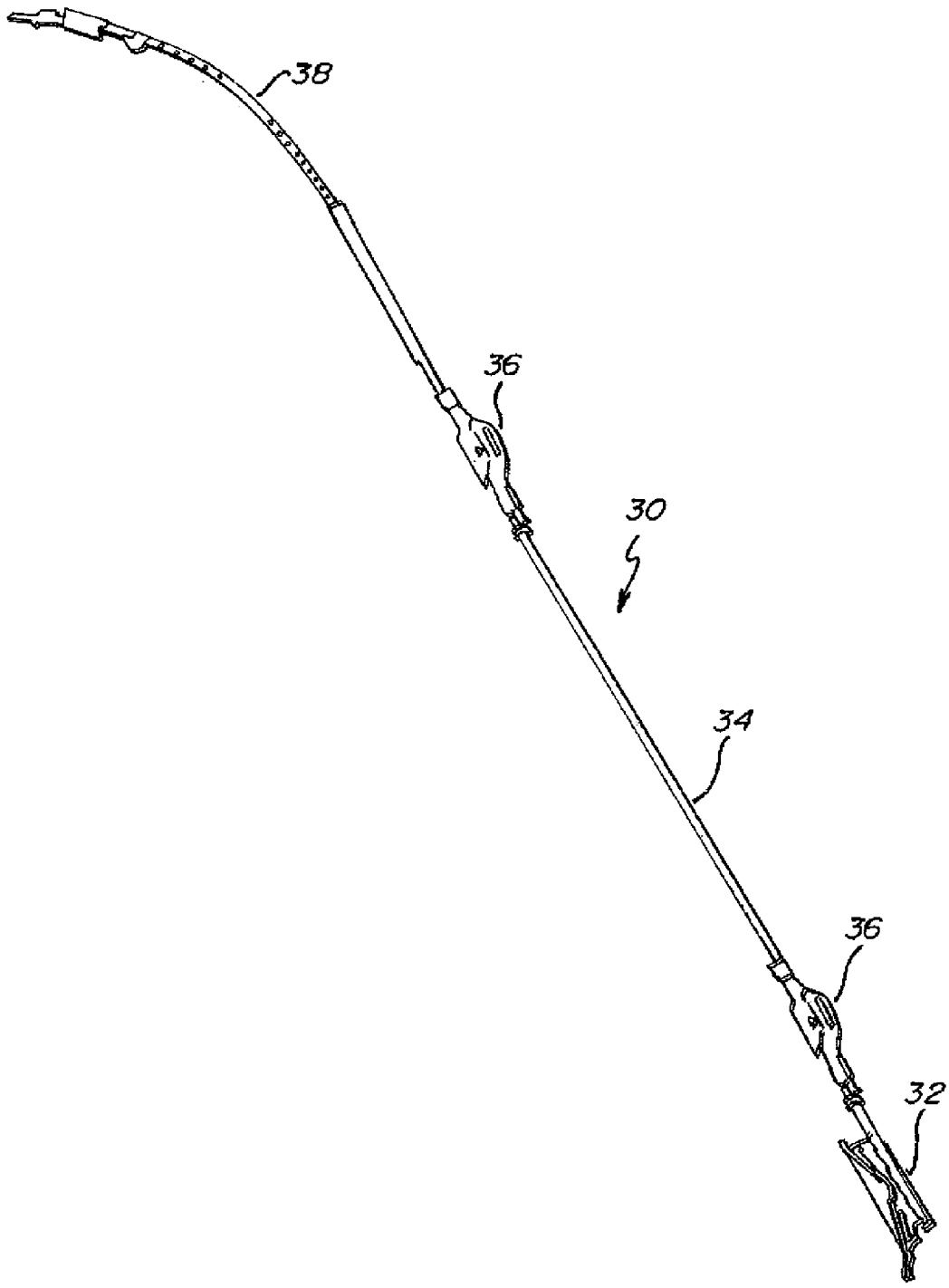
FIG. 1 is a perspective view of a first or linear embodiment of a multi-point sash lock system for casement window according to an embodiment of the invention.
Figure 1A:
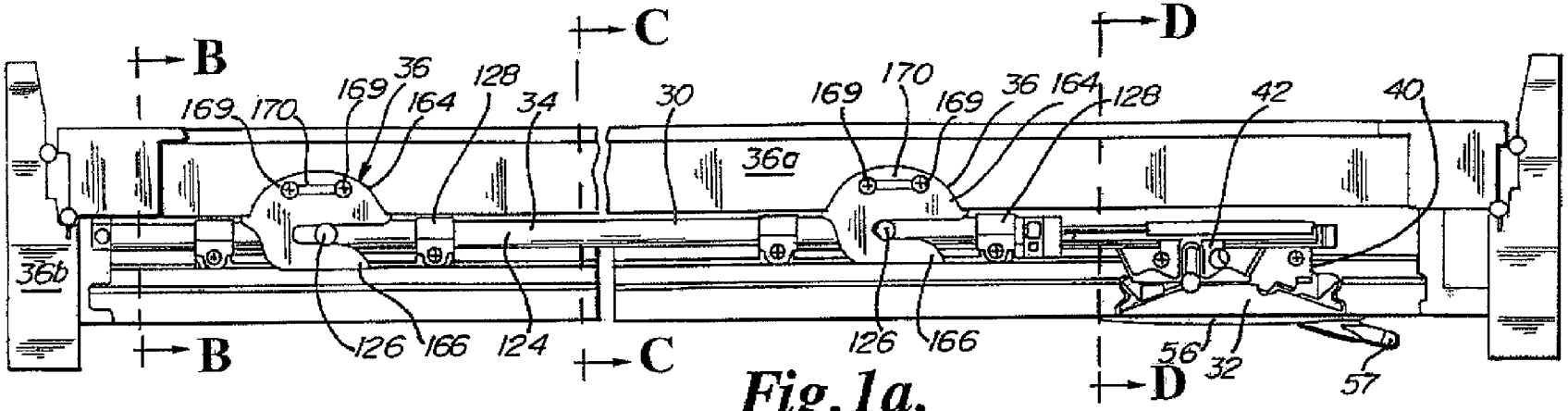
FIG. 1*a* is an elevation of a multi-point sash lock system for casement window according to an embodiment of the invention, depicted attached to a window sash and window frame.
Figure 1D:
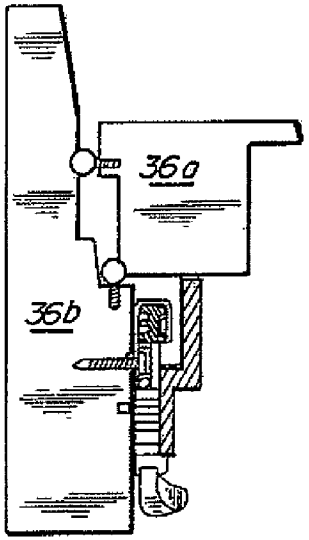
FIG. 1*d* is a cross-sectional view taken through section A-A of FIG. 1*a;*
Figure 1C:
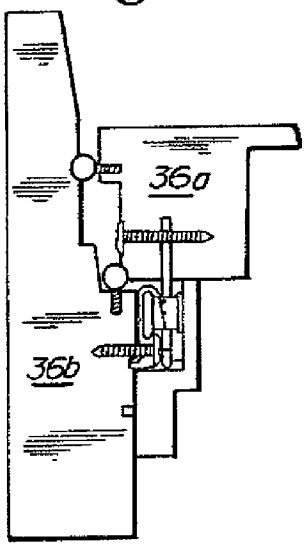
FIG. 1*c* is a cross-sectional view taken through section B-B of FIG. 1*a;*
Figure 1B:
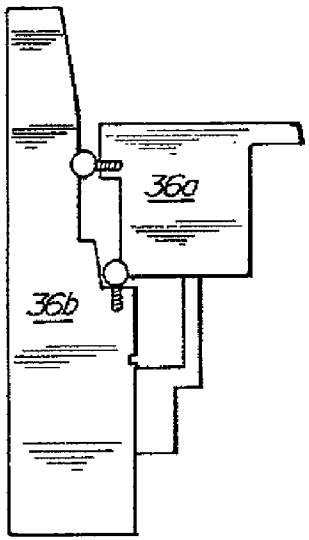
FIG. 1*b* is a cross-sectional view taken through section C-C of FIG. 1*a;*

Referring now to FIGS. 1-1*d*, 29, and 29*a*, multi-point sash lock assembly 30 generally includes drive assembly 32, tie-bar assembly 34, and biscuit keepers 36. Multi-point lock assembly 30 is used to latch and lock an operable window sash 36*a* with a window frame 36*b*. Optional round top window tie bar assembly 38 (see FIGS. 22-28) may be coupled to tie-bar assembly 34 if desired for latching an operable sash round-top window (depicted in part in FIG. 28).

Figure 3:
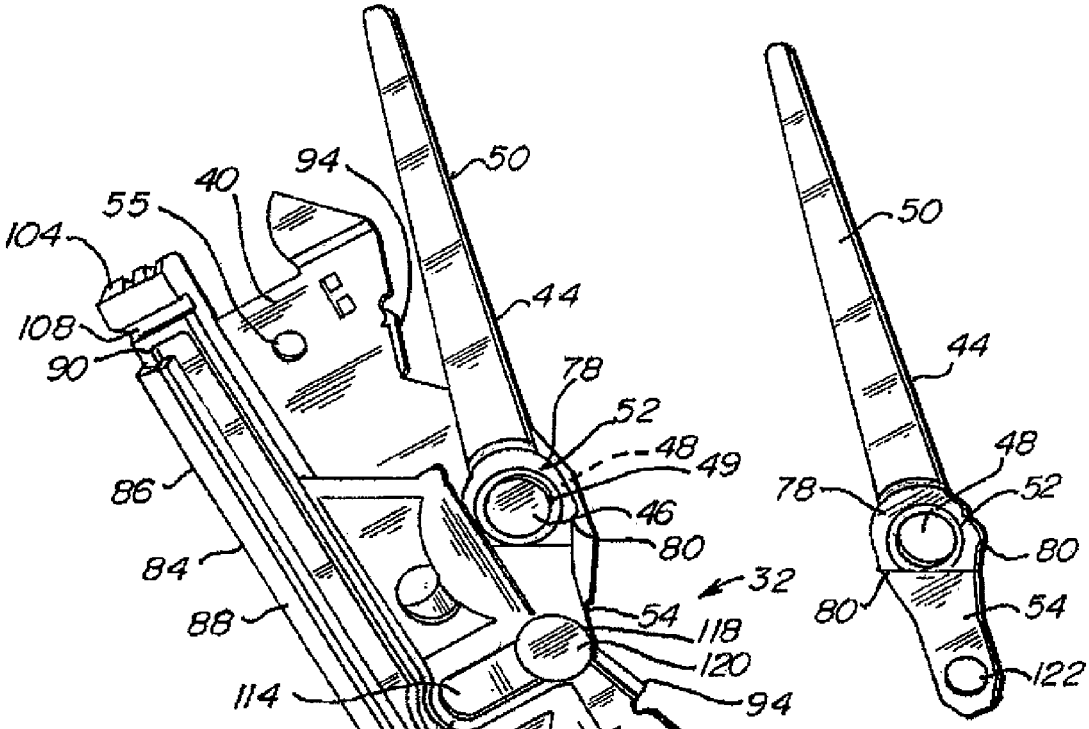
FIG. 3 is a perspective view of the lever portion of the drive mechanism of a multi-point sash lock system for casement window according to an embodiment of the invention.
Figure 2:
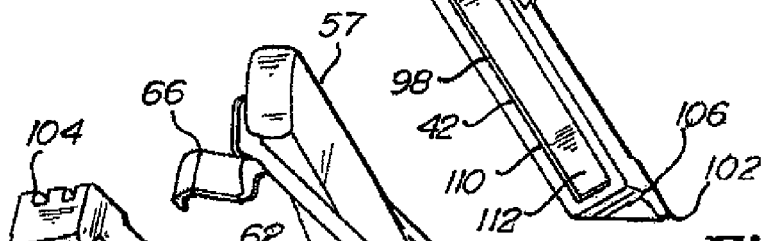
FIG. 2 is a partial perspective view of the drive mechanism of a multi-point sash lock system for casement window according to an embodiment of the invention, depicting the lever, base plate and slide portions of the mechanism.

Drive assembly 32 (see FIGS. 1-12) generally includes base plate 40, slide 42, and lever 44. Lever 44 is pivotally attached to base plate 40 with rivet 46, which extends through aperture 48 in lever 44 and aperture 49 in base plate 40. As depicted in FIGS. 2 and 3, lever 44 has handle portion 50, hub portion 52, and inner actuating portion 54. When multi-point lock assembly 30 is mounted in a window sash (FIGS. 29 and 29*a*), handle portion 50 extends through a slot in the window frame to enable multi-point lock assembly 30 to be actuated without the attachment of any finish hardware. Base plate 40 is secured to the window frame with fasteners extending through apertures 55.

Finish hardware is depicted in FIGS. 4, 5, and 8-11. To lend a finished appearance to the slot, removable escutcheon 56 may be fitted in the slot with handle cover 57 over handle portion 50 of lever 44. Escutcheon 56 generally includes body portion 58 with perimeter flange 60, well portion 62 defining recess 64, and flexible securing tabs 66 for engaging the ends of the slot to hold escutcheon 56 in place in the slot. Handle portion 50 extends through aperture 67 in well portion 62. Bottom walls 67*a* are advantageously sloped downwardly so that handle cover 57 engages them when lever 44 is at either a fully locked or fully unlocked position. Handle cover 57 effectively extends toe reach of handle portion 50, thereby making it easier to grasp the combination of the handle portion 50, handle cover 57.

Handle cover 57 has finger grip portion 68 and shank portion 70. Shank portion 70 has bifurcated end 72 with a pair of legs 74, each of which has an inwardly directed tab 76. Shank portion 70 is partially hollow so as to receive handle portion 50 of lever 44. Hub portion 52 of lever 44 has rounded edges 78 and opposing notched portions 80. When shank portion 70 is disposed over handle portion 50, legs 74 fit around rounded edges 78, and tabs 76 engage notched portions 80 to secure handle cover 57 on lever 44.

In an embodiment of the invention, handle portion 50 is sufficiently long so as to extend from the slot in the window sash even when handle cover 57 is not in place. Such arrangement facilitates construction, where it may be desirable or necessary to lock or unlock the window before installation and before the installation of the finish hardware, escutcheon 56 and handle cover 57. Escutcheon 56 and handle cover 57 may then be installed after all window installation is complete, thus alleviating the problem of damage to the finishes of these components during installation.

Figure 6:
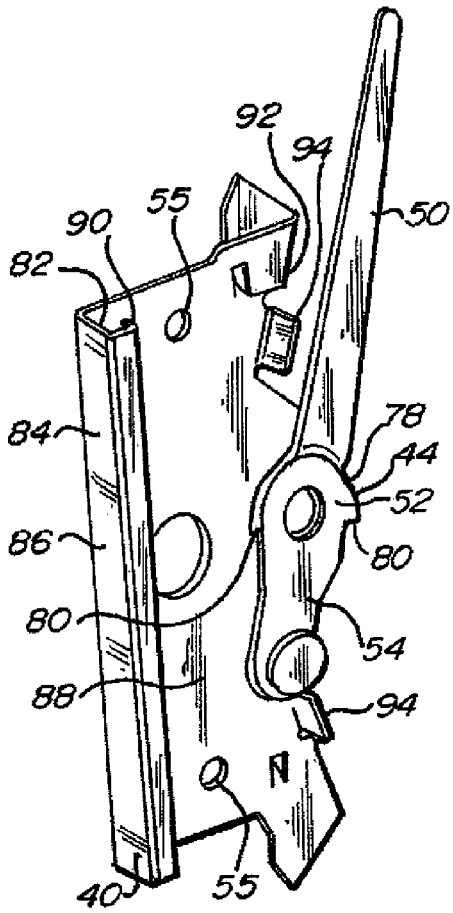
FIG. 6 is a partial perspective view of the drive mechanism of a multi-point sash lock system for casement window according to an embodiment of the invention, depicting the lever and base plate portions of the mechanism.

Base plate 40 is depicted in FIG. 6 and has channel 82 at bottom edge 84. Channel 82 has bottom wall 86, outward sidewall 88, and inwardly turned portion 90. Upper edge 92 has a pair of tabs 94 for engaging and supporting the bottom surface 96 of escutcheon 56.

Figure 4:
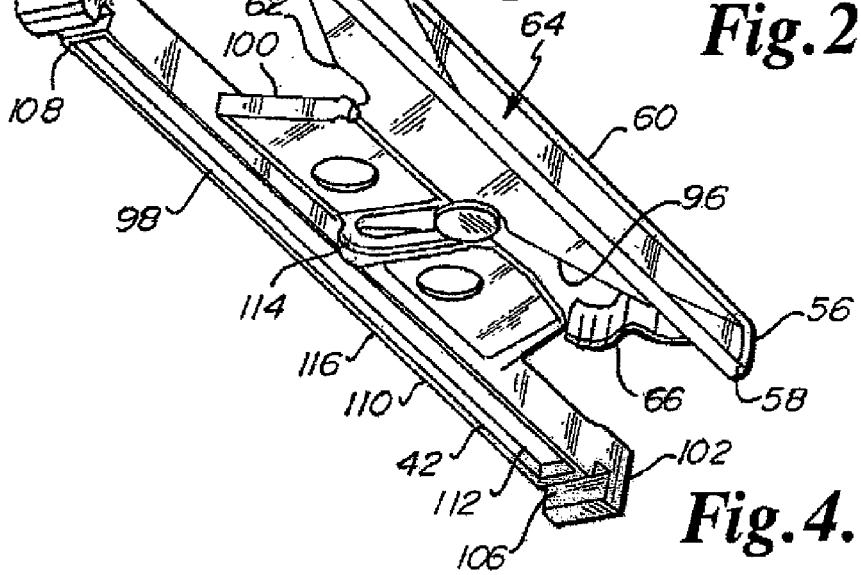
FIG. 4 is a partial perspective view of the drive mechanism of a multi-point sash lock system for casement window according to an embodiment of the invention, depicting the lever, escutcheon, handle cover, and slide portions of the mechanism.
Figure 4A:
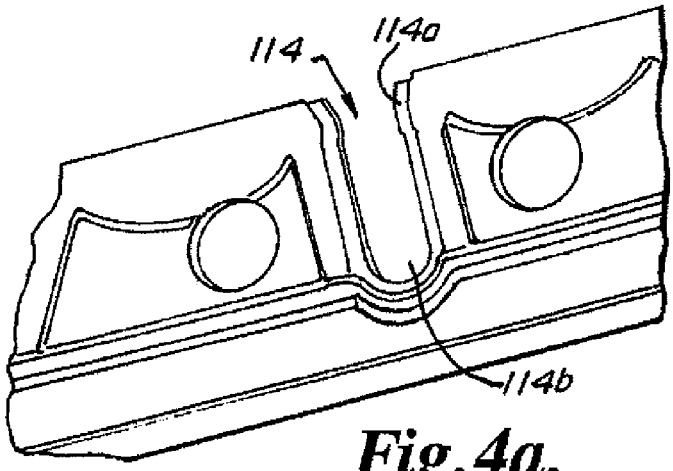
FIG. 4*a* is a partial perspective view of a portion of the slide of the drive mechanism of a multi-point sash lock system for casement window according to an embodiment of the invention.
Figure 5:
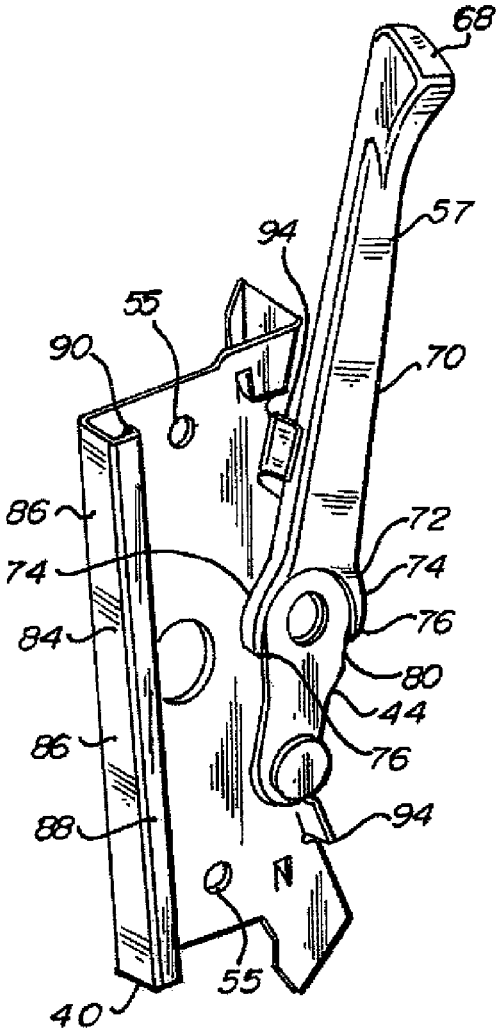
FIG. 5 is a partial perspective view of the drive mechanism of a multi-point sash lock system for casement window according to an embodiment of the invention, depicting the lever, handle cover, and base plate portions of the mechanism.

Referring to FIG. 4, slide 42 generally includes base portion 98 and riser 100. Opposing ends 102, 104 of base portion 98 have lateral notches 106, 108, respectively. Main body 110 of base portion 98 has lateral facing recess 112. Riser 100 has vertical notch 114 with shouldered region 116.

Figure 7:
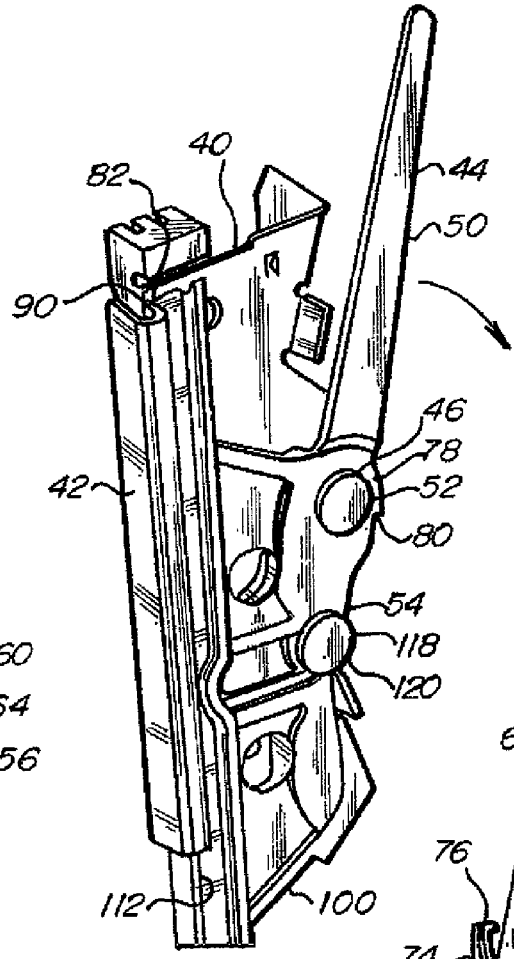
FIG. 7 is a partial perspective view of the drive mechanism of a multi-point sash lock system for casement window according to an embodiment of the invention, depicting the lever, slide, and base plate portions of the mechanism.
Figure 8:
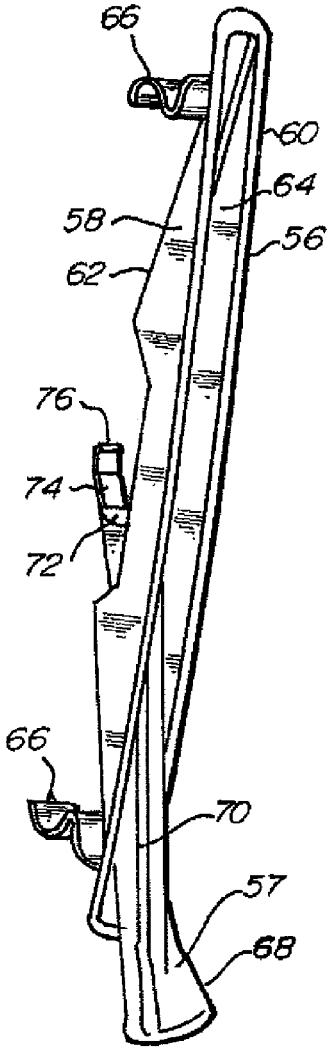
FIG. 8 is a front perspective view of an escutcheon and handle cover portion of a multi-point sash lock system for casement window according to an embodiment of the invention.
Figure 9:
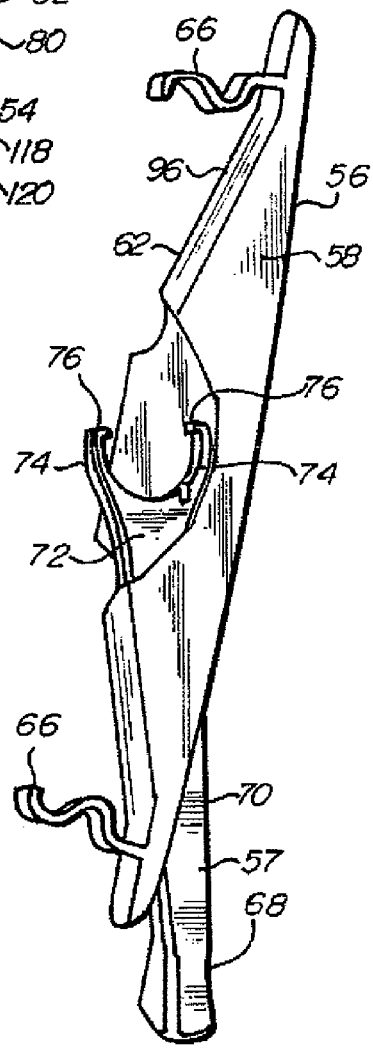
FIG. 9 is a rear perspective view of an escutcheon and handle cover portion of a multi-point sash lock system for casement window according to an embodiment of the invention.
Figures 10, 11, 12:
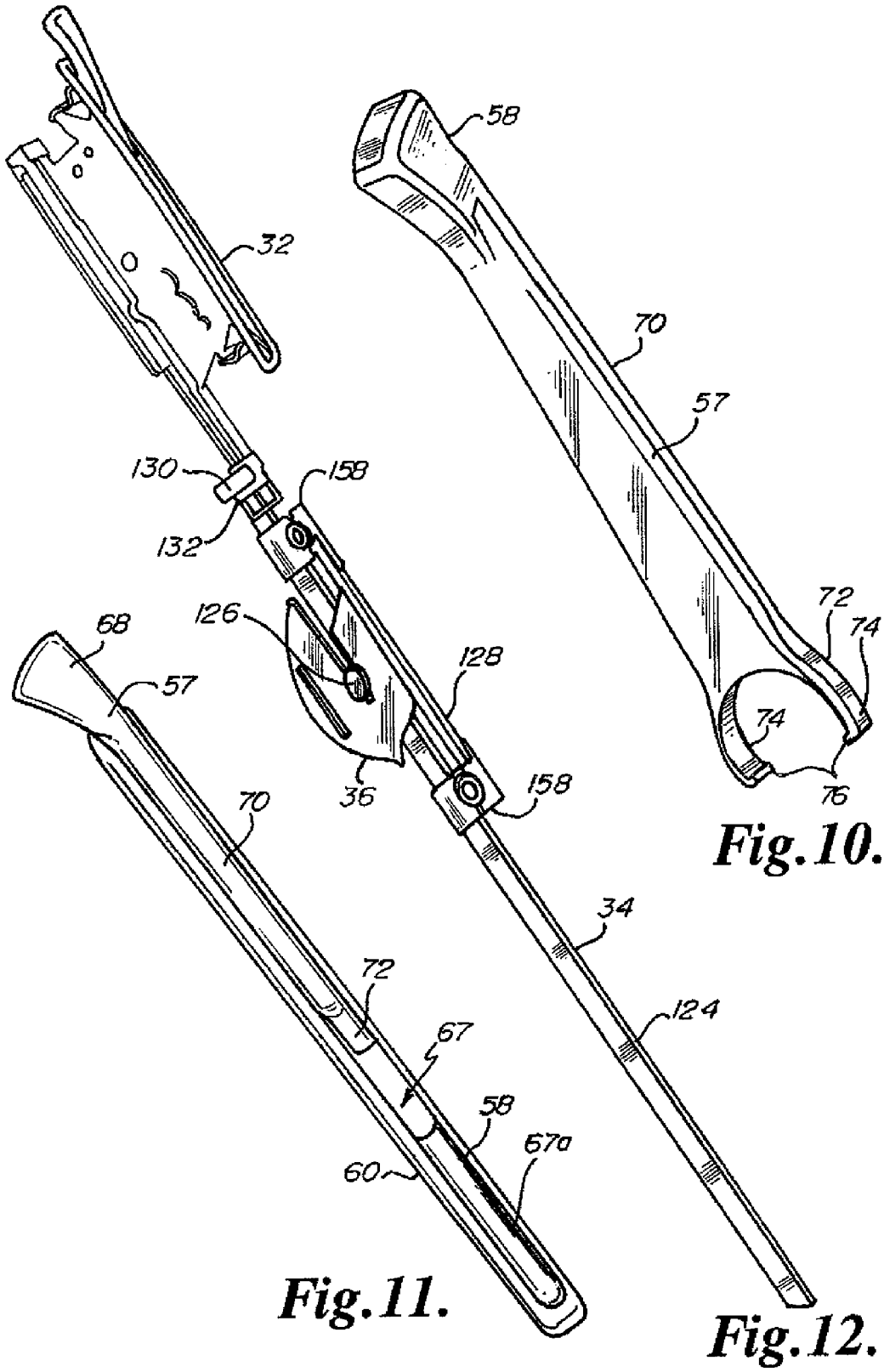
FIG. 10 is a perspective view of a handle cover portion of a multi-point sash lock system for casement window according to an embodiment of the invention.
FIG. 11 is a front elevation view of an escutcheon and handle cover portion of a multi-point sash lock system for casement window according to an embodiment of the invention.
FIG. 12 is a partial perspective view of a multi-point sash lock system for casement window according to an embodiment of the invention, depicting the lock drive, tie-bar assembly and biscuit keeper portions of the mechanism.
Figure 13:
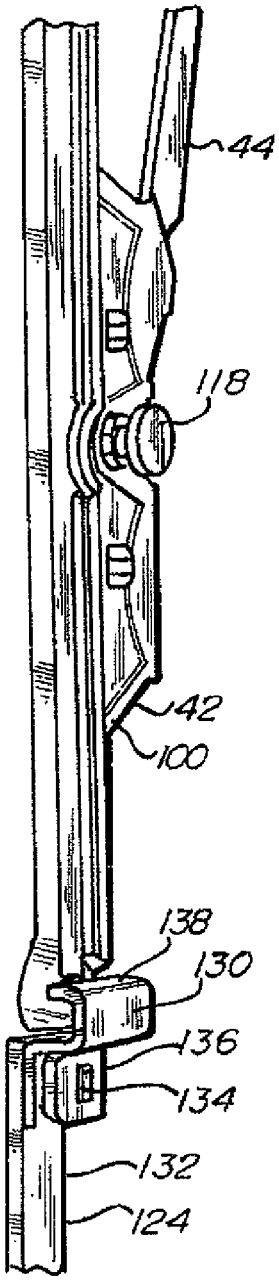
FIG. 13 is a partial perspective view of the connection between the slide portion of the lock drive assembly and the tie bar assembly of a multi-point sash lock system for casement window according to an embodiment of the invention.

As depicted in FIGS. 2 and 7, slide 42 engages and slides along inside channel 82 of base plate 40 with inwardly turned portion 90 received in lateral facing recess 112 to retain slide 42 in engagement with base plate 40. Rivet 118 having head 120 is secured to inner actuating portion 54 of lever 44 through aperture 122. Rivet 118 is engaged in vertical notch 114 of slide 42 with head 120 riding in shouldered region 116.

In operation, as lever 44 is rotated in the direction of the arrow about rivet 46 (FIG. 7), rivet 118 moves downwardly in vertical notch 114, causing slide 42 to slide within channel 82 in a direction opposite the direction of movement of lever 44. The length of inner actuating portion 54 is selected so that rivet 118 does not bottom in vertical notch 114 when lever 44 is at the midpoint of travel. Those of skill in the art will appreciate that slide 42 and lever 44 function as a classic "lost-motion" mechanism.

It is desirable that top portion 114*a* of vertical notch 114 be slightly narrower than bottom portion 114*b*, and that top portion 114*a* be slightly smaller than the diameter of the shank portion of rivet 118 so as to offer additional frictional resistance to sliding of rivet 118. This combination of features provides a positive detent-like function at both ends of travel of lever 44, tending to retain lever 44 in the fully locked and unlocked positions through friction between rivet 118 and the edges of vertical notch 114, and to provide positive tactile feedback to an operator to indicate the fully locked and fully unlocked positions have been reached.

As depicted in FIGS. 1, 12-16 and 19, tie bar assembly 34 generally includes tie bar 124 with roller assemblies 126 and tie bar guides 128. Link 130 is riveted to end 132 of tie bar 124 with square rivet 134 through square aperture 136. Lip portion 138 engages in one of lateral notches 106, 108, in slide 42 to link tie bar 124 to drive assembly 32.

Figure 14:
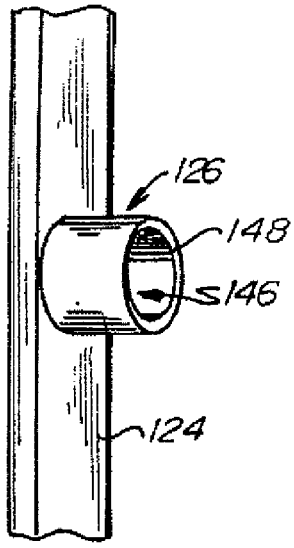
FIG. 14 is a partial perspective view of the roller portion of the roller assembly and a portion of the tie bar of a multi-point sash lock system for casement window according to an embodiment of the invention.
Figure 15:
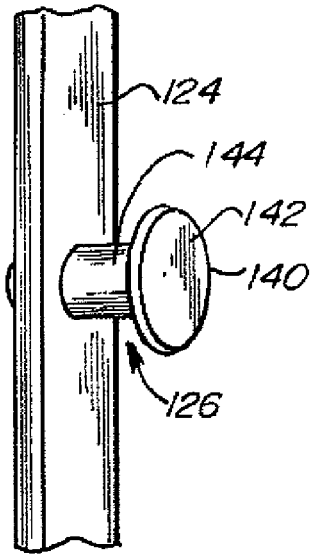
FIG. 15 is a partial perspective view of the rivet portion of the roller assembly and a portion of the tie bar of a multi-point sash lock system for casement window according to an embodiment of the invention.
Figure 16:
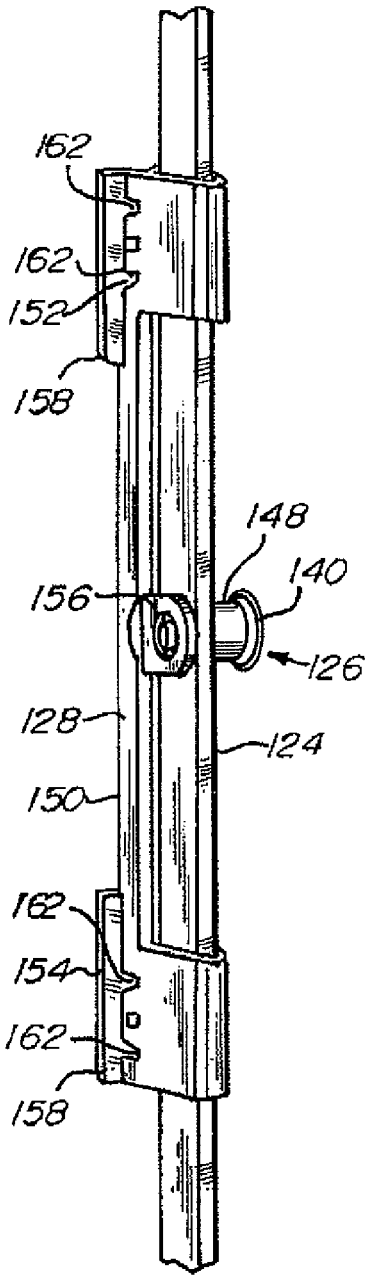
FIG. 16 is a partial perspective view of the tie-bar guide assembly of a multi-point sash lock system for casement window according to an embodiment of the invention, depicting the tie-bar guide and tie-bar together.

Each roller assembly 126 as depicted in FIGS. 14-16 includes a rivet 140 having a head 142 and a shank 144. Shank 144 extends through bore 146 of roller 148 so that roller 148 rotates on shank 144. Although in the depicted embodiment, rivet 140 and bore 146 are axially aligned with roller 148 being symmetrical about the common axis, it will be appreciated that bore 146 may be asymmetrical in roller 148 so that roller assembly 126 is eccentric as taught in U.S. Pat. No. 4,803,808 to Greisner, hereby fully incorporated herein by reference.

Figure 17:
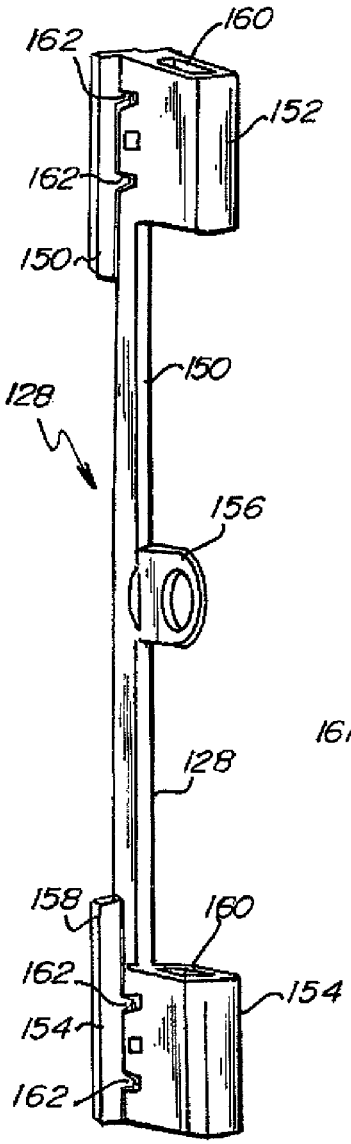
FIG. 17 is a partial perspective view of the tie-bar guide assembly of a multi-point sash lock system for casement window according to an embodiment of the invention, depicting the tie-bar guide.
Figure 18:
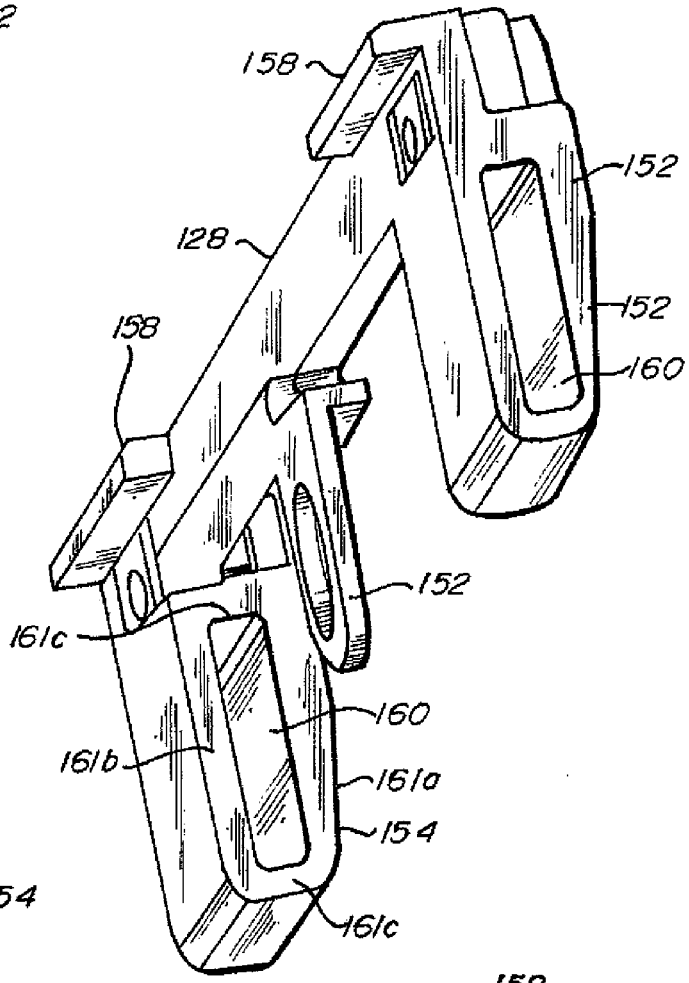
FIG. 18 is another partial perspective view of the tie-bar guide assembly of a multi-point sash lock system for casement window according to an embodiment of the invention, depicting the tie-bar guide.
Figure 18A:
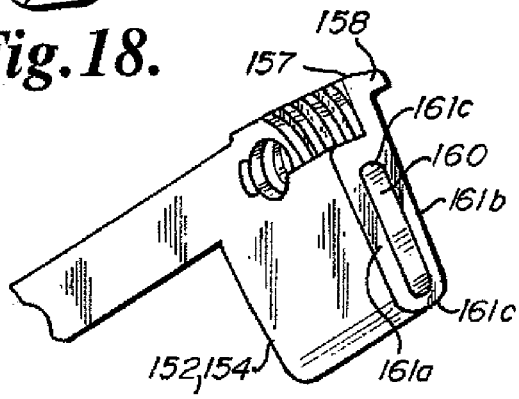
FIG. 18*a* is a partial perspective view of a further embodiment of a guide end of the tie-bar guide assembly.
Figure 22:
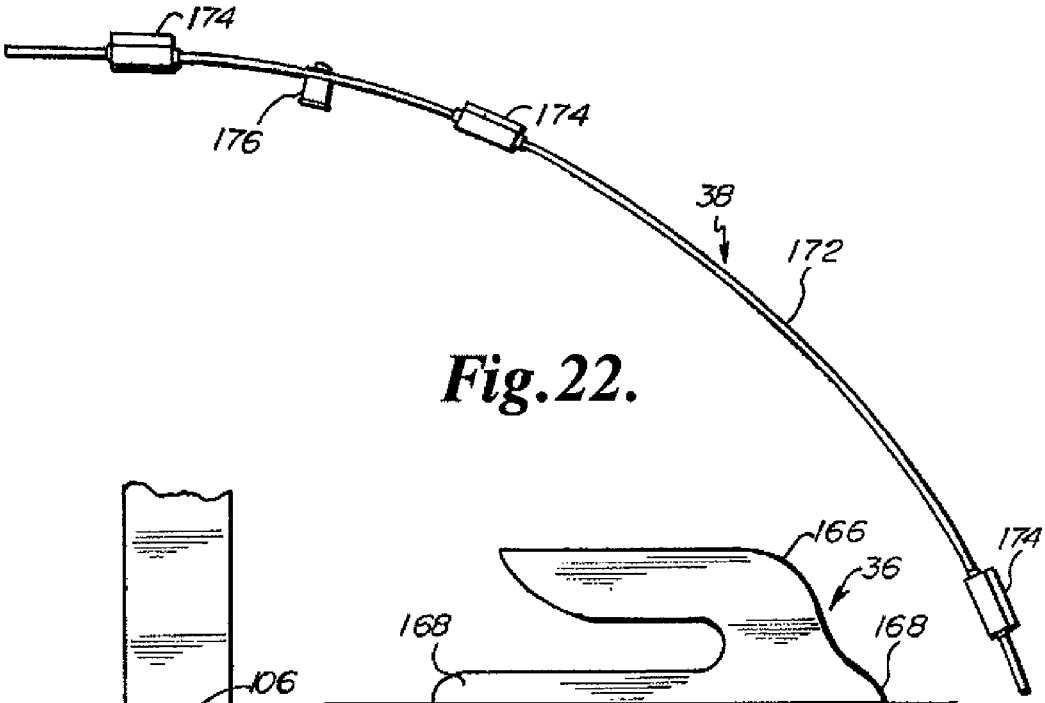
FIG. 22 is a side elevation view of a second or curved embodiment of the present invention, including the curved tie-bar assembly of a multi-point sash lock system for a round top casement window.

As depicted in FIGS. 17 and 18, tie bar guide 128 generally includes central body portion 150, guide ends 152, 154, and locating tab 156. At least the central body portion 150 and the guide ends 152, 154 are preferably integrally, unitarily formed. Locating tab 156 preferably is formed with a frangible coupling to the tie bar guide 128. Locating lip 158 is provided to engage in a groove in the window frame to locate tie bar assembly 34 at a predetermined distance from the window sash. In the embodiment of FIG. 18*a*, the locating lip 158 and the portion of the backwall 157 that in part defines the locating lip 158 do not diminish in thickness. Accordingly, the locating lip 158 has a rectangular cross section. Guide ends 152, 154, each have an aperture 160 for slidably receiving tie bar 124 therethrough. Each aperture 160 is formed by a back wall 161*a*, a spaced apart front wall 161*b* and two connecting ends 161*c*. The front wall 161*b* is ribless. One or more apertures 162 may be provided on tie bar guide 128 for receiving fasteners to attach the guide to a window frame.

When tie bar assembly 34 is originally assembled and before installation, locating tab 156 is riveted to tie bar 124 with rivet 140 in order to locate tie bar guide 128 at the proper position lengthwise along tie bar 124 for installation. The first time tie bar assembly 34 is operated from the locked disposition to the unlocked disposition, tie bar 124 forcibly slides longitudinally in tie bar guides 128. The force of such translation causes the locating tab 156 frangible coupling to the tie bar guide 128 to be sheared. Locating tab 156 is thereby permanently separated from central body portion 150. Locating tab 156 however remains attached to tie bar 124 with rivet 140 for the remainder of the life of the mechanism.

Figure 20:
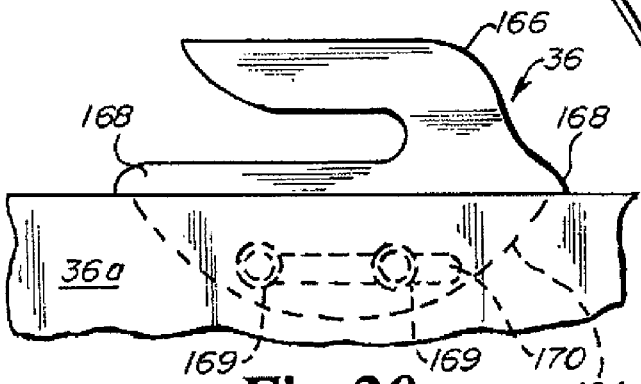
FIG. 20 is a side elevation view of a biscuit keeper of the present invention, depicting the keeper received in a slot in a window sash.
Figure 19:
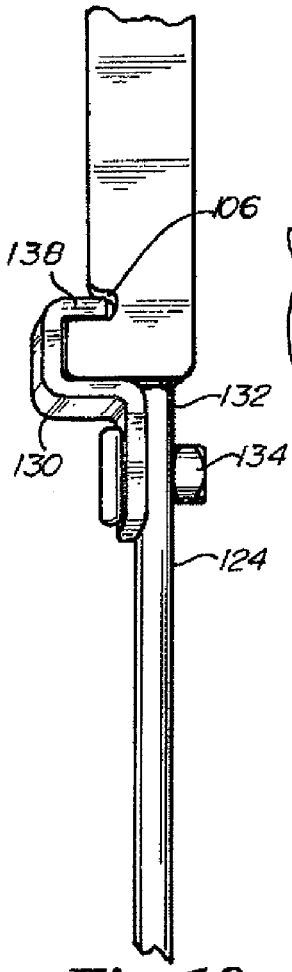
FIG. 19 is a partial perspective view of the connection between the slide portion of the lock drive assembly and the tie bar assembly of a multi-point sash lock system for casement window according to an embodiment of the invention.
Figure 21:
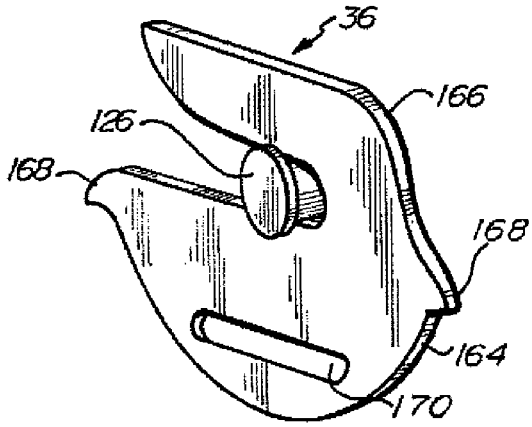
FIG. 21 is a perspective view of the biscuit keeper of FIG. 20 with a roller assembly received between the base and hook portions of the keeper.
Figure 23:
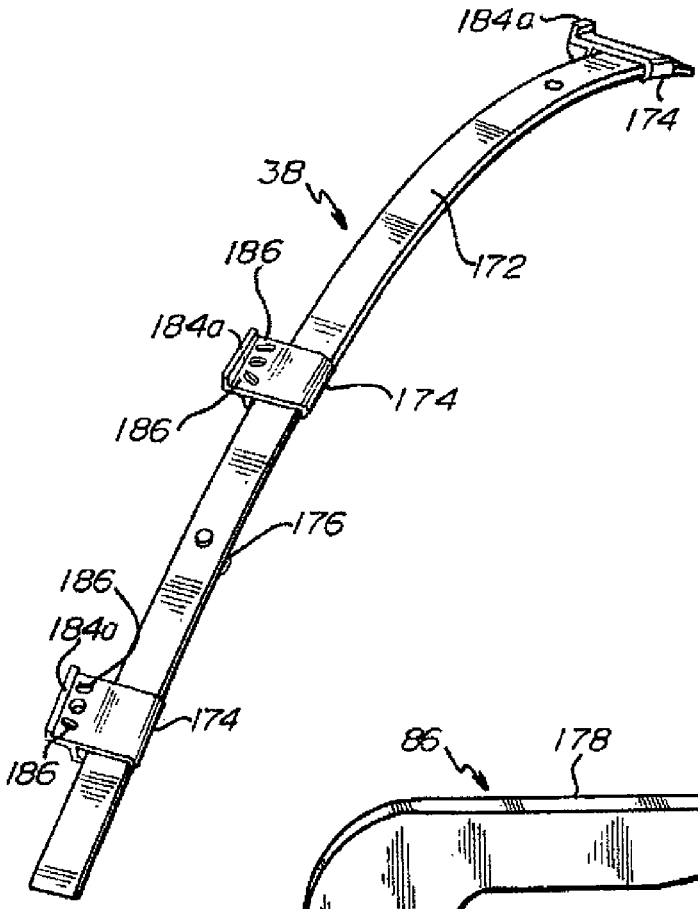
FIG. 23 is a top perspective view of the curved tie-bar assembly of a multi-point sash lock system for casement window according to an embodiment of the invention.

Biscuit keeper 36 (see FIGS. 20 and 21) generally includes main body portion 164 and hook portion 166. Keeper 36 is installed in a window sash by first cutting a slot in the sash by suitable means such as a plunge saw. Once the slot is cut, main body portion 164 is inserted in the slot until shoulders 168 engage the surface of the window sash around the slot. One or more fasteners 169 can be inserted through slot 170 in main body portion 164 to secure the keeper 36 in place. When installed in this position, hook portion 166 projects outwardly from the window sash, and is positioned so as to align with roller assemblies 126.

In locking operation, as lock drive assembly 32 is operated as described above, slide 42 causes tie bar 124 to slide in tie bar guides 128. Roller assemblies 126 engage keepers 36 between hook portion 166 and main body portion 164 to hold the sash in engagement with the window frame.

Figure 27:
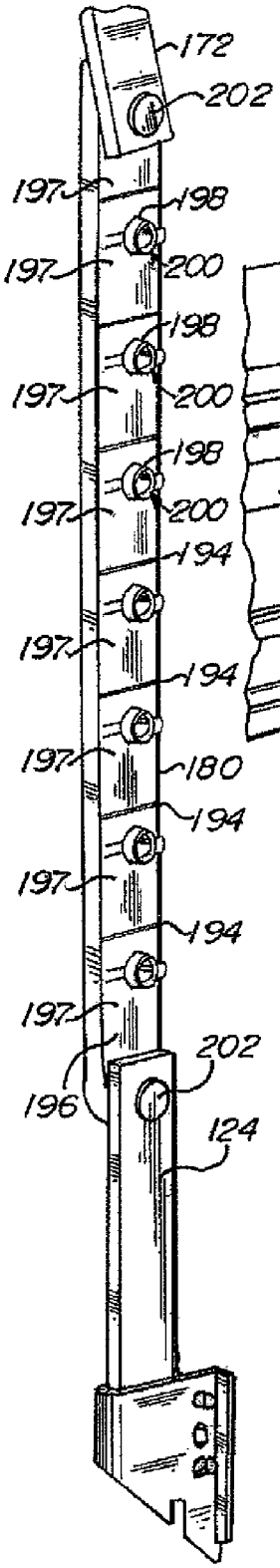
FIG. 27 is a perspective view of the adjustable link linking the curved tie-bar to the straight tie-bar of a multi-point sash lock system for casement window according to an embodiment of the invention.
Figure 28:
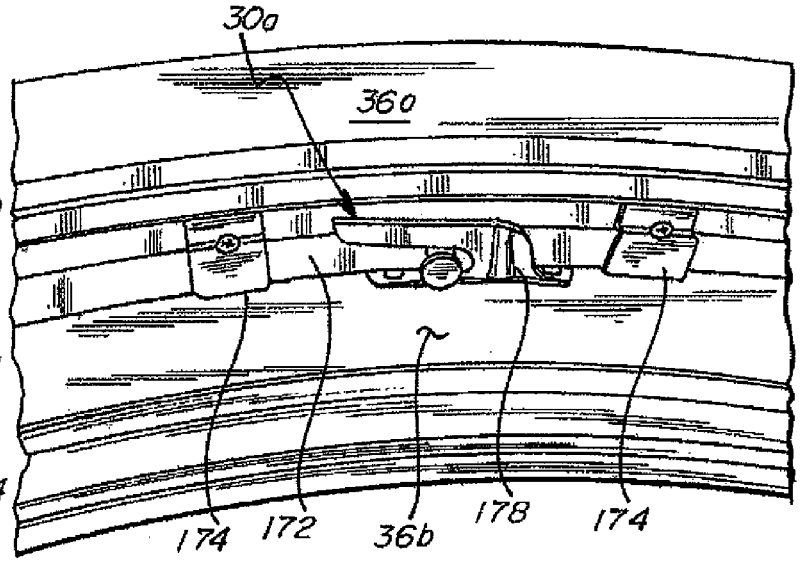
FIG. 28 is a photograph of a portion of the curved tie-bar assembly with the tie-bar and guides attached to a window frame and the keeper attached to a window sash and with the roller assembly received in the keeper.
Figure 29A:
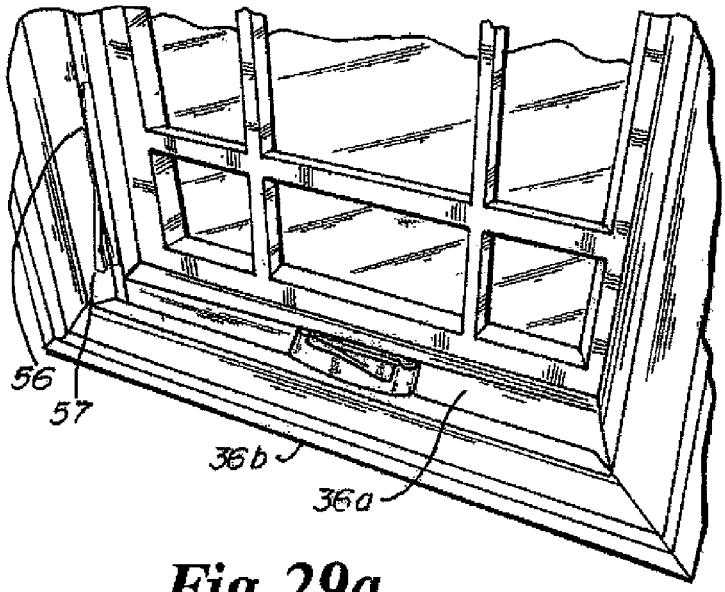
FIG. 29*a* is another photograph of a casement window equipped with the multi-point sash lock of the first embodiment of the present invention.
Figure 29:
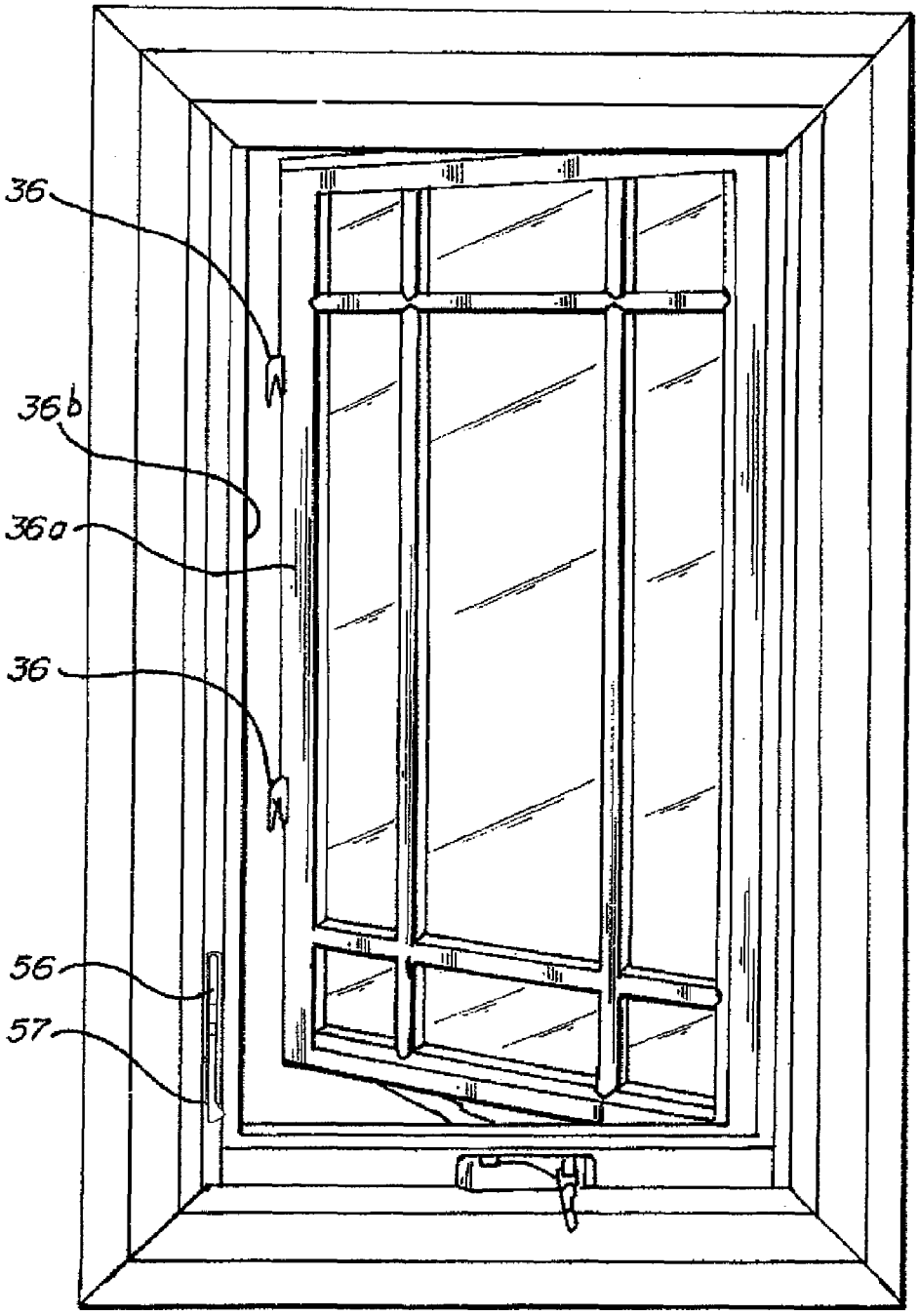
FIG. 29 is a photograph of a casement window equipped with the multi-point sash lock of the first embodiment of the present invention.

Referring now to FIGS. 22-28, a round top window multi-point lock assembly 30*a* generally includes drive assembly 32, round window tie-bar assembly 38, and biscuit keepers 36. Multi-point lock assembly 30*a* is used to latch and lock around top window operable window sash 36*a* with a window frame 36*b*, as depicted in FIG. 28. Multi-point lock assembly 30*a* functions in substantially the same manner as multi-point lock assembly 30, noted above, and includes substantially similar components as multi-point lock assembly 30, thereby ensuring that similar functioning and similar appearing lock assemblies 30, 30*a* may be used in a unit window that includes both rectangular and round top windows. This enhances ease of use of the window unit and the appearance of the window unit.

Optional round top window tie bar assembly 38 generally includes the same components as tie-bar assembly 34, described above. Window tie bar assembly 38 generally includes curved tie bar 172, tie bar guides 174, roller assembly 176, keeper 178, and adjustable link 180. Tie bar guides 174 have body portion 182 with an aperture 184 for slidably receiving curved tie bar 172 therethrough. Moreover, each tie bar guide 174 may have locating lip 184*a* for engaging in a groove in the window frame to locate the assembly 38 the proper distance from the window sash. Apertures 186 are provided to receive fasteners to secure the tie bar guide 174 to the window frame.

Figure 25:
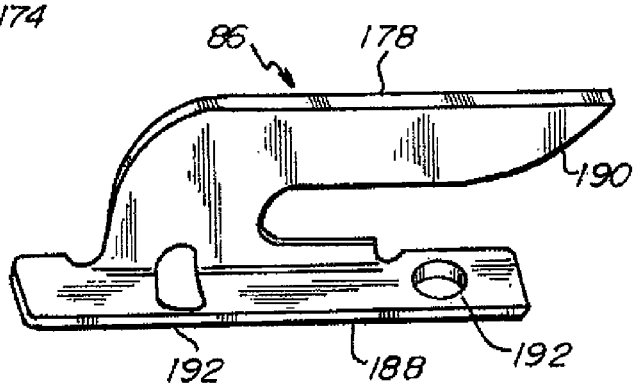
FIG. 25 is a perspective view of the keeper portion of a curved tie-bar assembly of a multi-point sash lock system for casement window according to an embodiment of the invention.
Figure 26:
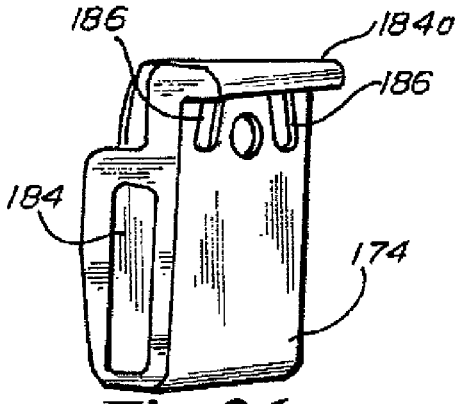
FIG. 26 is a perspective view of the tie-bar guide portion of a curved tie-bar assembly of a multi-point sash lock system for casement window according to an embodiment of the invention.
Figure 24:
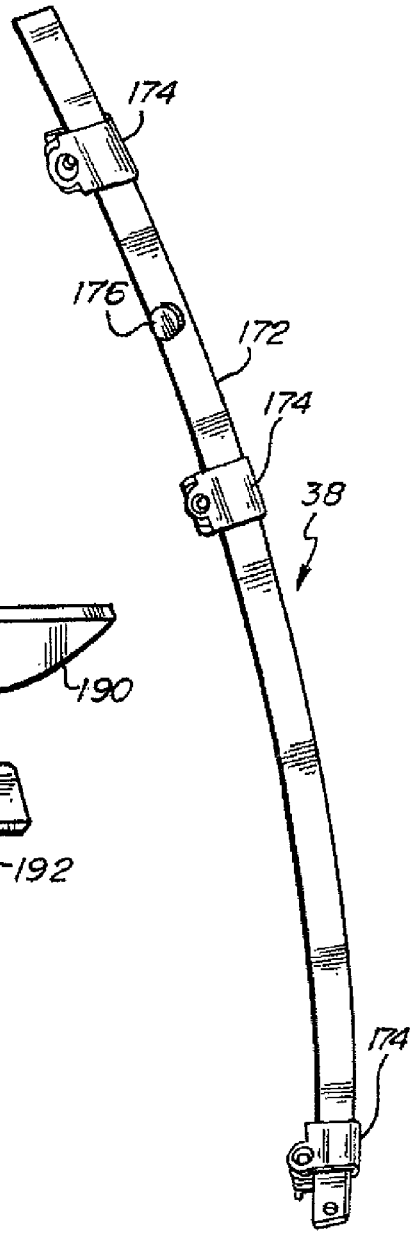
FIG. 24 is a bottom perspective view of the curved tie-bar assembly of a multi-point sash lock system for casement window according to an embodiment of the invention.

Keeper 178 has lower flange portion 188 and hook portion 190, as depicted in FIG. 25. Keeper 178 is secured to the window sash with one or more fasteners through apertures 192.

Referring to FIG. 27, curved tie bar 172 is linked to tie bar 124 with adjustable link 180. Link 180 has a series of v-shaped notches 194 spaced apart along main body 196, thereby defining segments 197 Bosses 198 are positioned in each respective segment 197 between each pair of notches 194. Each boss 198 has an aperture 200 formed therethrough for receiving a screw 202 to attach opposing ends of link 180 to either tie bar 124 or curved tie bar 172. Link 180 can be adjusted to a desired length by snapping off a segment(s) 197 of the link at any of notches 194. Link 180 is desirably made from brittle zinc material to enable easy and clean breaks at notches 194, but may also be made from any other suitably frangible material.

In operation, longitudinal movement of tie bar 124 upon operation of lever 44 is transmitted to curved tie bar 172 though adjustable link 180. Curved tie bar 172 slides through guides 174, causing roller assembly 178 to move in and out of engagement with keepers 178.

What is claimed is:

1. A multi-point sash lock assembly being shiftable between a locked and an unlocked disposition, comprising:

a tie bar assembly including a tie bar guide and a tie bar, the tie bar guide having a pair of spaced apart guide ends coupled by a body portion, each of the guide ends defining an aperture and being integrally, unitarily formed in a single continuous piece around the aperture, wherein the tie bar is slidably received through the apertures of both of the guide ends, the tie bar guide further comprising a locating tab projecting from the body portion, the locating tab coupled to the body portion with a frangible connection and being riveted to the tie bar, wherein the locating tab is severed from the tie bar guide at the frangible connection by a first shifting of the multi-point sash lock assembly out of the locked disposition, and wherein the locating tab remains riveted to the tie bar.

2. The multi-point sash lock assembly of claim 1, wherein the body portion is formed integrally, unitarily with the guide ends.

3. The multi-point sash lock assembly of claim 1, wherein each guide end comprises a back wall, a spaced apart front wall, the back wall and the front wall being joined by two ends, the front wall being formed ribless.

4. The multi-point sash lock assembly of claim 1, wherein the tie bar assembly further comprises a roller engageable with at least one sash mounted biscuit keeper when in the locked disposition, the at least one sash mounted biscuit keeper having a single elongate slot for receiving at least one fastener for fastening the biscuit keeper to a window sash.

5. A multi-point sash lock assembly for securing a rounded side of a window to a rounded window frame, comprising:

a tie bar assembly having a tie bar longitudinally slidable by means of an actuatable lock drive, the tie bar having at least one roller for engaging a respective keeper, the tie bar being guided with a plurality of guides secured to a window frame, the tie bar being curved to conform to the rounded side of the window, the curved tie bar linked to a linear tie bar with an intermediate link, the intermediate link formed from brittle metal material and comprising a plurality of segments, each segment separated from an adjacent segment by a generally v-shaped notch, wherein the intermediate link is permanently adjustable from a first length to a second shorter length by snapping off one or more of the segments from a remainder of the intermediate link at one of the notches between adjacent segments.

6. The multi-point sash lock assembly of claim 5, each of the segments having a bore defined therein for receiving a fastener for fastening the segment to a selected one of the curved tie bar and the linear tie bar.

7. A method of forming a multi-point sash lock assembly for securing a rounded side of a window to a rounded window frame, and a straight side of an adjacent window to an adjacent straight window frame, comprising:

providing a tie bar assembly having a straight tie bar, and a curved tie-bar;

guiding the curved tie bar with a plurality of guides secured to the rounded window frame guiding the straight tie bar with a plurality of guides secured to the straight window frame;

providing a link member made from brittle material, the link member comprising a plurality of adjacent segments separated by generally v-shaped notches;

shortening the link member by snapping off one or more of the segments from a remainder of the link member at one of the notches;

attaching the remainder of the link member to the straight tie bar and the curved tie bar to operably couple the straight tie bar to the curved tie bar.

* * * * *